US005388299A

United States Patent [19]

Lee

[11] Patent Number: 5,388,299

[45] Date of Patent: Feb. 14, 1995

[54] WASHING CONTROL SYSTEM OF A WASHING MACHINE

[75] Inventor: Dong K. Lee, Seoul, Rep. of Korea

[73] Assignee: Goldstar Co., Ltd., Seoul, Rep. of Korea

[21] Appl. No.: 223,879

[22] Filed: Apr. 6, 1994

[30] Foreign Application Priority Data

Apr. 6, 1993 [KR] Rep. of Korea ..... 1993-5700

[51] Int. Cl.[6] ..... D06F 33/02

[52] U.S. Cl. ..... 8/159; 68/12.02; 68/12.18; 68/12.19; 68/12.21

[58] Field of Search ..... 8/158, 154; 68/12.01, 68/12.02, 12.18, 12.19, 12.21, 12.16, 12.27

[56] References Cited

U.S. PATENT DOCUMENTS

| | | | |
|---|---|---|---|
| 4,303,406 | 12/1981 | Ross | 68/12.27 |
| 4,400,838 | 8/1983 | Stears et al. | 68/12.19 X |
| 5,072,473 | 12/1991 | Thuruta et al. | 8/159 |
| 5,259,217 | 11/1993 | Civanelli et al. | 68/12.02 |

FOREIGN PATENT DOCUMENTS

| | | | |
|---|---|---|---|
| 224890 | 7/1985 | Germany | 68/12.18 |
| 61-172591 | 8/1986 | Japan | 68/12.18 |
| 61-232891 | 10/1986 | Japan | 68/12.18 |
| 64-15094 | 1/1989 | Japan | 68/12.18 |

*Primary Examiner*—Frankie L. Stinson
*Attorney, Agent, or Firm*—Morgan & Finnegan

[57] ABSTRACT

This invention relates to a washing control system of a washing machine which is provided to have a capability of carrying out the best washing, using accurate washing information required in washing, which comprises steps of reading washing information on information mediums attached on clothes and storing into corresponding memory, checking possibility of mixed washing with the stored information, displaying a condition when mixed washing is impossible according to the checking and storing information of total weight of fiber obtained from the stored washing information into a corresponding memory when mixed washing is possible, searching the corresponding memory for washing information on application of washing start signal, and carrying out washing after setting up required various washing conditions either according to the total weight of fiber and the property information stored in the washing information on finding stored washing information as the result of the search, or detecting the quantity of laundry on finding no stored washing information.

7 Claims, 3 Drawing Sheets

WASHING CONTROL SYSTEM OF A WASHING MACHINE

FIELD OF THE INVENTION

This invention relates to a washing control system of a washing machine, more particularly to a washing control system of a washing machine which is provided to have a capability of carrying out the best washing, using accurate washing information required in washing.

BACKGROUND OF THE INVENTION

In general, the washing control of a washing machine is carried out by setting washing water level and washing period of time depending on the detected amount of laundry introduced into a washing tub.

FIG. 1 is a washing control system of a washing machine including a key pad 101 generating key signals to select a desired washing cycle such as number of times of washing, of rinsing, and of drying, washing course, and washing period of time to be taken according to a user's pressing of the keys, a system control part 100 controlling overall system operation of the washing machine in response to the key signals selected in the key pad 101, a motor operation part 102 having triac TA1 and TA2 controlling operation of a washing motor 103 by switching on/off applied alternative current power in response to the control signals transmitted from the system control part 100, laundry quantity sensing part 104 having resistances R11 and R12, diodes D11 and D12, and a photocoupler PC1, sensing quantity of laundry inside of a washing tub and transmitting to the system control part 100 using the residual power generated by the inertia of the washing motor 103 after turn-off of the washing motor 103, and a display part displaying various status of operations in response to the control signals of the system control part 104.

When a user, after introducing laundry into the washing tub, sets up a washing cycle by pressing washing keys on the key pad 101, the system control part 100 reads in the key signals and initiates washing operation of the washing machine. That is, a feed water valve(not shown) is opened to feed washing water up to a predetermined level.

When feeding of washing water has been completed, the system control part 100 switches on/off the triacs TA1 and TA2 of the motor operation part alternatively for a certain time to detect the quantity of laundry introduced into the washing tub. Accordingly, the washing motor 103 rotates either in clockwise or anticlockwise direction alternatively. After a certain period of time has been lapsed, the system control part 100 switches off the triacs TA1 and TA2 of the motor operation part 102 to stop driving of the motor 103. In this time, the washing motor 103 slows down by the inertia of the washing motor 103 until it comes to a complete stop.

When there is more laundry in the washing tub, the rotation of the washing motor 103 would stop earlier due to more friction between a pulsator and laundry, and, when there is less laundry, the rotation speed of the washing motor 103 would decrease slowly due to less friction.

The laundry quantity sensing part 104 detects the residual voltage generated by the inertia of the washing motor 103, carries out waveform shaping thereof and transmits therefrom to the system control part 100. In another words, the residual power generated in the washing motor 103 depending on the quantity of laundry, turns on/off a light emitting diode LD11 through the resistance R11 and the diode D11 of the laundry quantity sensing part 104. As a light receiving element TR11 is turned on/off depending on the turn on/off of the light emitting diode LD11, power source electrode voltage Vcc is transmitted to the system control part 100 through the resistance R12 in waveform.

The system control part 100 determines the quantity of laundry according to the number of waves obtained by the laundry quantity sensing part 104, based on which quantity, one of washing water levels of high, middle and low as well as washing period of time are determined.

For example, when small number of waves are transmitted from the laundry quantity sensing part 104, determining quantity of laundry being great, the washing period of time is set longer and the washing water level is set high, and when the number of waves transmitted from the laundry quantity sensing part 104 is great, determining quantity of laundry being little, the washing period of time is set shorter and the washing water level is set low.

After setting the washing water level and washing period of time as foregoing description, the system control part 100 opens to supply washing water up to the set level, and drives the washing motor 103 in pulsating manner through the motor operation part 102, carrying out washing, which is displayed on the display part 105.

However, as the settings of washing operation is determined according to the current(residual voltage), the foregoing washing machine can detect the quantity of laundry approximately, but not exactly due to the serious dependency of the current(residual voltage) on the characteristics of the washing motor, belt tension and slip on and between the washing motor and the clutch, operating voltage of the washing motor and the disposed condition of the laundry in the washing tub. Accordingly, because the washing water quantity and the washing period of time, rate of rinse, and drying period of time can not be set properly, damage of laundry, waste of power and water can be caused.

And, because the properties of the laundry in the washing tub can not be known, there is problem in forming of proper washing water current in the washing tub and subsequent performing optimum washing.

SUMMARY OF THE INVENTION

The object of this invention is to provide a washing control system of a washing machine which is provided to carry out the best washing according to bar codes attached on laundry having washing information such as properties, weight, way of washing etc.

These and other objects and the features of this invention can be achieved by a washing control method of a washing machine including steps of reading washing information on information mediums attached on clothes and storing into corresponding memory, checking possibility of washing with the stored in formation, displaying a condition when washing is impossible as the result of checking and storing information of total weight of fiber obtained from the stored washing information into a corresponding memory when washing is possible, searching the corresponding memory for washing information on application of washing start signal, and carrying out washing after setting up required various washing conditions either according to the total weight of fibre and the property information stored in the washing information on finding stored washing information as the result of the search, or detecting the quantity of laundry on finding no stored washing information, and a washing control device of a washing machine including information mediums having information required in washing for attaching on clothes, a washing information application sensing means placed on a predetermined position of a washing machine body for sensing washing information recorded on the information mediums on washing, a system control means for setting up various conditions required for washing and controlling overall system operation of the washing machine according to the washing information sensed through the washing information sensing application means, and a display means for displaying warning in response to a control signal indicating an impossibility of mixed washing transmitted from the system control means.

DETAILED DESCRIPTION OF THE INVENTION

Figure 1:
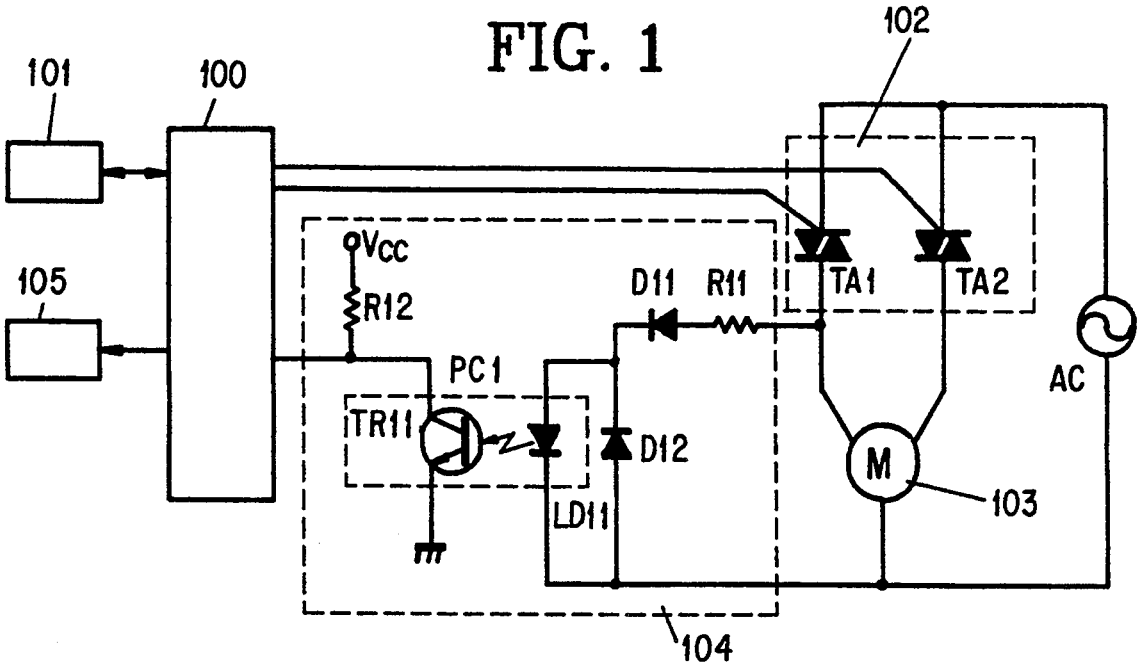
FIG. 1 is a conventional washing control device of a washing machine.
Figure 2:
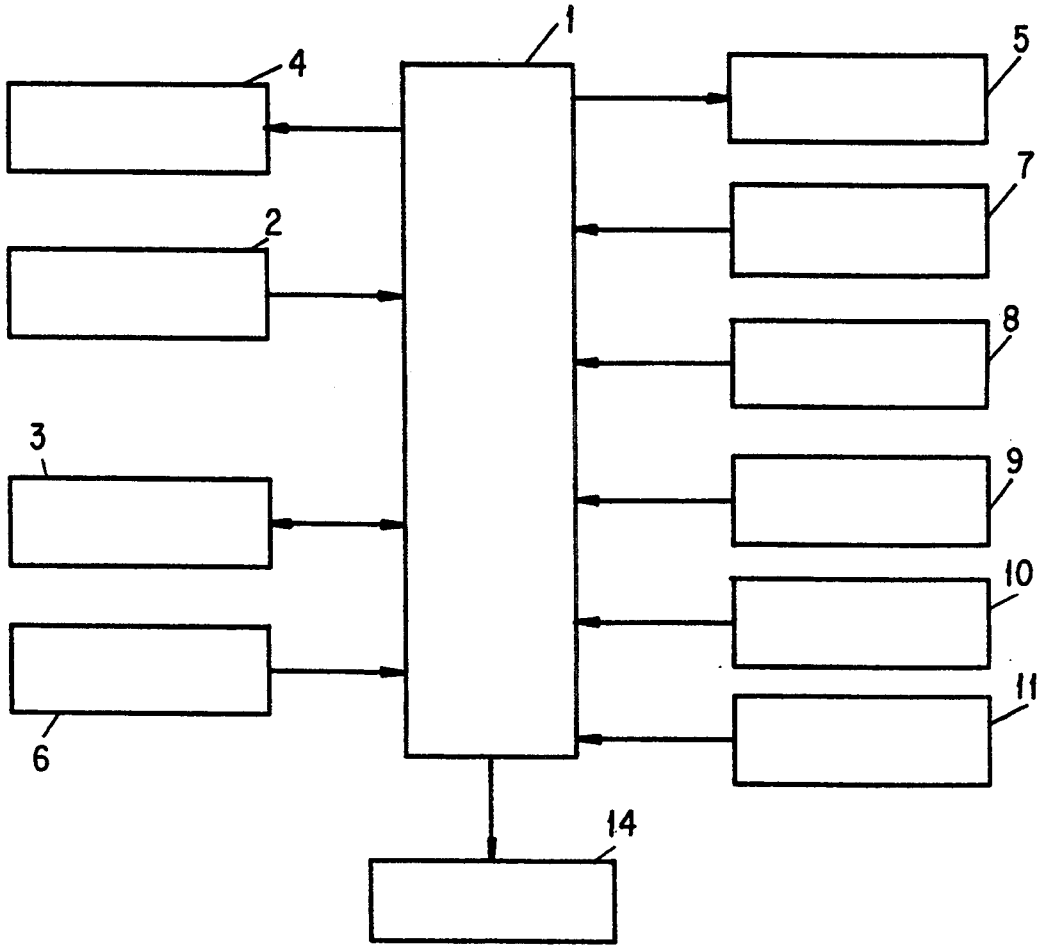
FIG. 2 is a washing control device of a washing machine in accordance with this invention.
Figure 3:
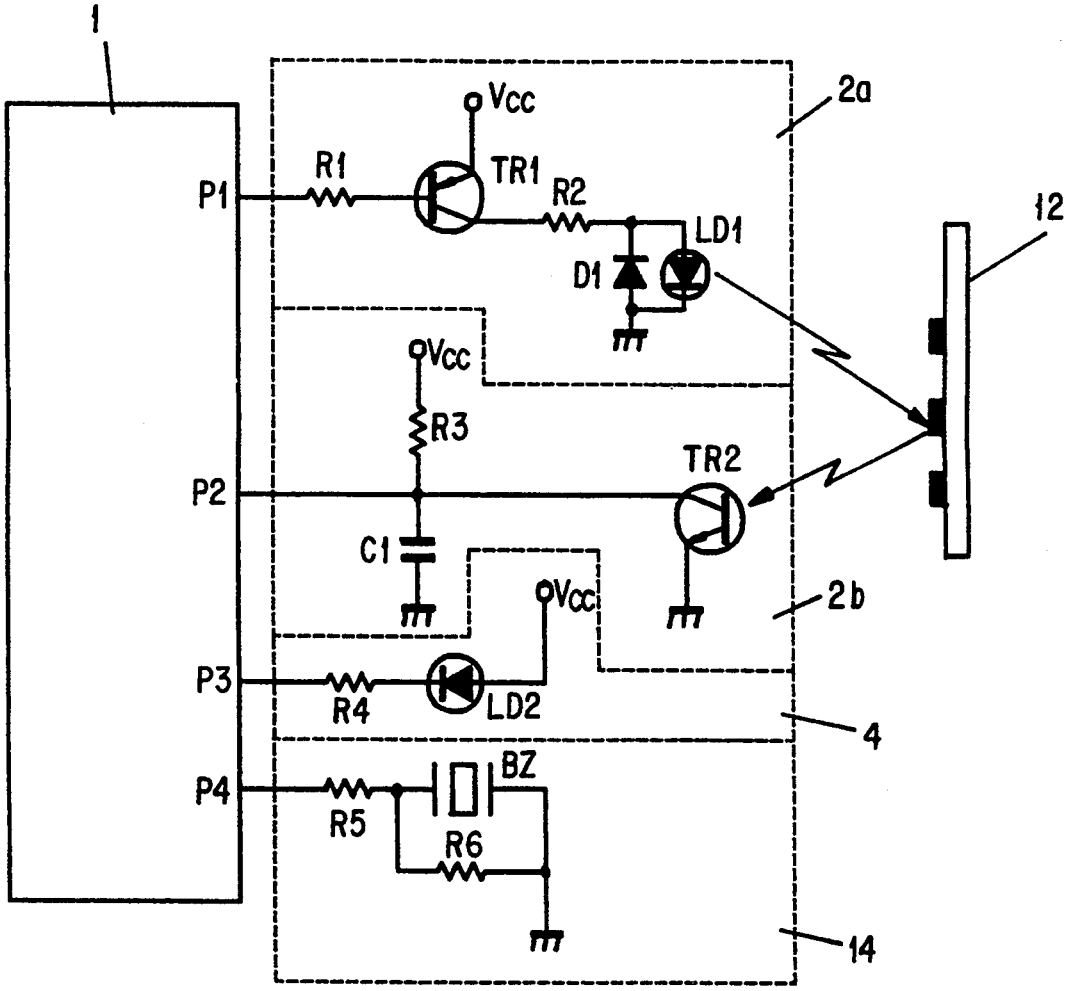
FIG. 3 is a detailed circuit diagram about a washing information application sensing part, a display part, and a buzzer sounding part of FIG. 2.

FIG. 2 is a washing control device of a washing machine in accordance with this invention and FIG. 3 is a detailed circuit diagram about a washing information application sensing part, a display part and a buzzer sounding part of FIG. 2, including a key pad 3 producing desired key signals of a washing cycle with keys thereon pressed by a user, a system control part 1 generating control signals controlling overall system operation of a washing machine in response to the key signals of the key pad 3, a power supply part 10 supplying operation power to entire system of the washing machine after making a voltage of incoming alternative current constant at a certain level, a load driving part 5 controlling operation of a washing motor in response to the control signals of the system control part 1, an oscillator part 7 providing clock signals to the system control part 1 in response to a preset oscillation frequency, a water level sensing part 6 generating a sensing signal on sensing water level supplied into a washing tub and transmitting therefrom to the system control part 1, a reset part 9 stabilizing operation of the washing machine by initializing the system control part 1 on turn-off of power, an interrupt generation part 8 generating an interrupt signals at each cycle by recognizing points of waves crossing at zero as signals upon supplied with power at a required frequency, information mediums 12 attached on clothes having all washing information such as properties of laundry, weight of laundry, way of washing recorded thereon, a washing information application sensing part 2 placed on a position of the washing machine body generating sensing signals on sensing washing information recorded on the information mediums 12 on washing and transmitting therefrom, to the system control part 1, a display part 4 having a resistance R4 and a light emitting diode LD2 indicating condition of being not possible of mixed washing in response to a control signal of the system control part 1 generated in response to the sensing signal of the washing information application sensing part 2, and a buzzer sounding part 14 having resistances R4 and R6 and a buzzer BZ and sounding of being not possible of mixed washing in response to the control signal of the system control part 1.

The washing information application sensing part 2 includes a light emission part 2*a* having resistances R1 and R2, a transistor TR1, a light emitting diode LD1 and a diode and emitting light signals onto an information medium 12 attached on an article of clothes switched by the control signal of the system control part 1, and a light receiving part 2*b* having a resistance R3, a condenser C1 and a light receiving element TR1, receiving the light reflected at the information medium 12 and transmitting therefrom to the system control part 1.

The information medium 12, being a washing information either bar coded or recorded on magnetic tape, is attached on an article of clothes in a code made under agreement with apparel business circle.

Figure 4:
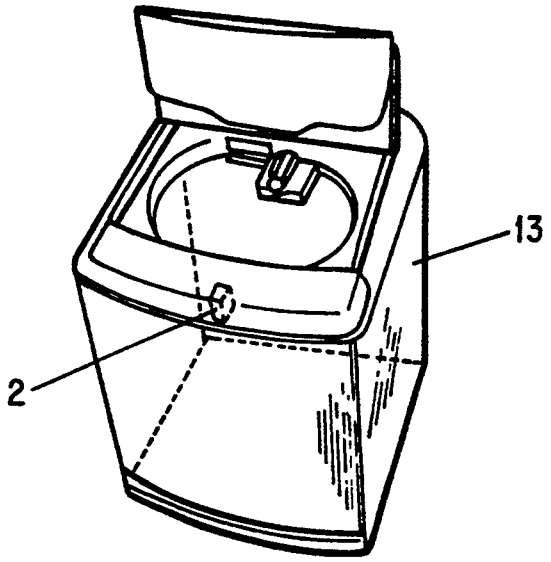
FIG. 4 is perspective view of a washing machine showing attachment of a washing information application sensing part of FIG. 2.

An article of clothes attached with an information medium ie., either a bar code recorded with washing information or a piece of magnetic tape recorded with washing information, is detected of all washing information such as properties of fibre, weight of fibre and way of washing with the information medium by the washing information application sensing part 2 attached on a front surface of the washing machine body 13 as shown in FIG. 4.

Figure 5:
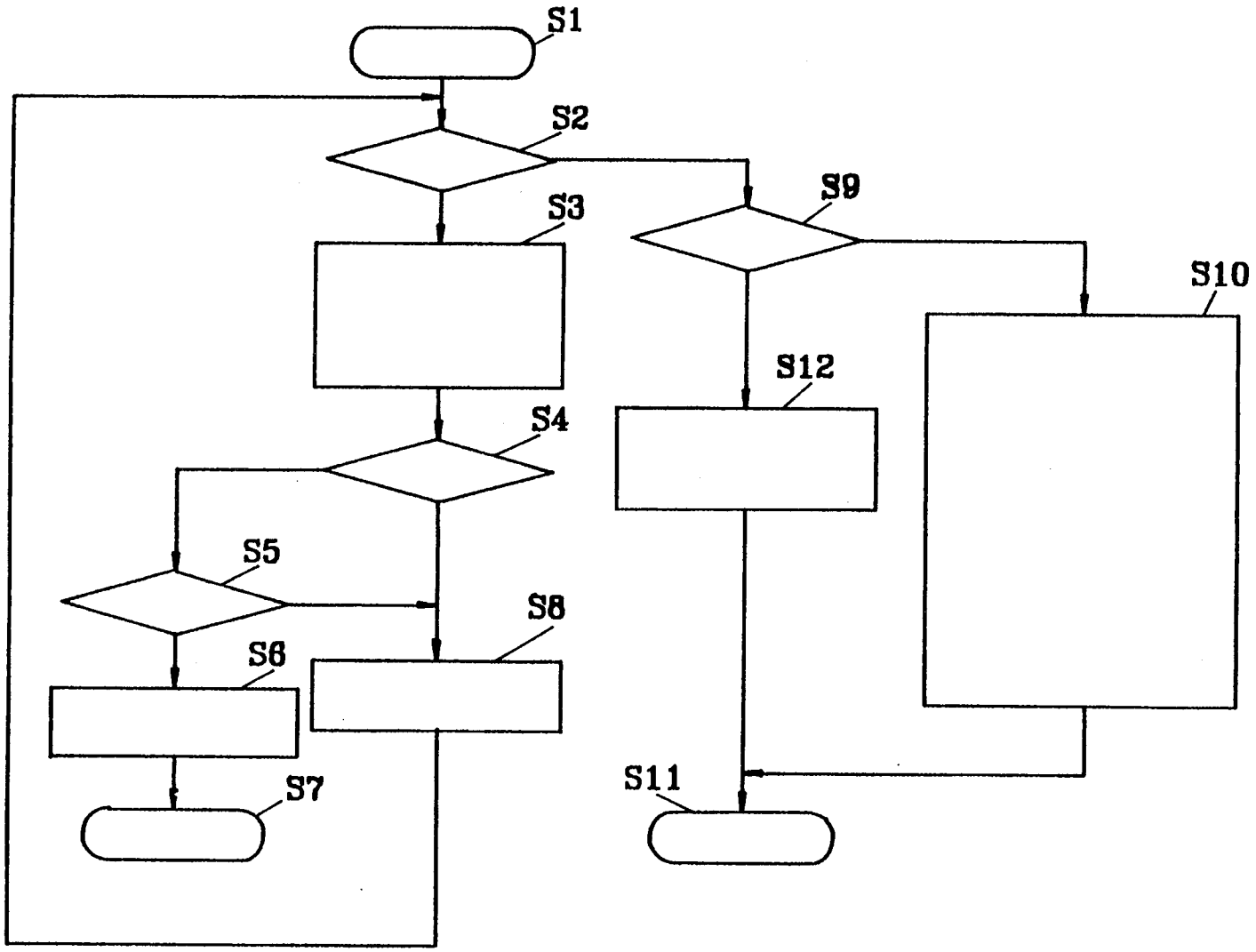
FIG. 5 is a flow chart explaining an operation of a washing control device of a washing machine in accordance with this invention.

The operation of a washing control device in accordance with this invention is to be explained hereinafter, referring to FIG. 5.

Upon turning on of power(step S1), the system control part 1 start operation by the power supplied from the power supply part 10, scanning the key signals of the key application part 3 searching for any application of washing start key(step S2).

In case the washing start key has not been applied, the washing information application sensing part 2 is controlled. That is, when the information medium 12 attached on an article of clothes to be washed is made to come close to the washing information application sensing part 2 attached on the upper part of the washing machine body 13, the light emission part 2*a* of the washing information application sensing part 2 emits light actuated by a low signal transmitted from the system control part 1. In more detail, when a low signal of an output port P1 of the system control part 1 is applied to a base of a transistor TR1 through the resistance R1, the transistor TR1 is turned on by the applied low signal. Thus, the turned on light emission diode LD1 by the voltage Vcc of the power supply electrode emits light signals onto an information medium 12 having washing information such as properties of fiber, weight of fiber and temperature of washing etc., The light emitted to the information medium 12, reflected at the information medium 12, incident to the light receiving element TR2 of the light receiving part 2. The light receiving element TR2 receives the light of washing information reflected at the information medium 12 and transmits therefrom to the input port P2 of the system control part 1.

The system control part 1 reads in washing information such as properties of fiber, weight of fiber and washing temperature etc., transmitted from the light receiving part 2*b* of the washing information application sensing part 2 and stores into the corresponding memory(step S3), based on which stored fiber information, checks whether more than one kind of fibers have been introduced(step S4).

As the result of the checking, in case it is found that more than one kind of fibers have been introduced therein, possibility of mixed washing is checked(step S5).

As the result of the checking, in case it is found that clothes of either wool or silk are introduced together with clothes of other fibers, the light emission diode LD2 of the display part 4 and the buzzer BZ of the buzzer sounding part 14 are turned on through output ports P3 and P4 informing to a user that a mixed washing is impossible, and the system is controlled so as not to proceed washing(steps S6 and S7).

As the result of the checking in the step S5, in case it is found that more than one kind of fibers have not been introduced or mixed washing is possible, a total weight a sum of the weights of each introduced fibers together with the rated washing weight of the washing machine is stored into corresponding memory(step S8).

When a user presses the washing start key of the key application part 3 after completion of storing washing information and introduction of laundry, the system control part 1 determines washing water level, quantity of detergent, washing period of time, number of times of rinsing and drying period of time based on the total weight information of laundry stored in the total weight memory, washing water current and rotating force of the washing motor in drying based on clothes property information stored in the clothes property memory, and selection of a feed water valve(not shown) of warm water or cold water based on washing temperature information stored in the temperature memory(steps S9 and S10).

Upon completion of foregoing determination, washing water is filled up to the determined level in the washing tub and washing proceeds for the determined washing period of time(step S11).

As explained in foregoing description, in accordance with this invention, it is possible to obtain the best washing effect and prevent damage of laundry in washing and waste of power by carrying out washing based on washing information such as properties of laundry, weight of laundry, way of washing which can vary depending on laundry, attached on each article of clothes after bar coded or recorded on a magnetic tape under agreement with apparel business circle.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A washing control method of a washing machine comprising steps of reading washing information on information mediums attached on clothes and storing into corresponding memory;

checking possibility of mixed washing with the stored information;

displaying a condition when mixed washing is impossible according to the checking and storing information of total weight of fiber obtained from the stored washing information into a corresponding memory when mixed washing is possible;

searching the corresponding memory for washing information on application of washing start signal; and carrying out washing after setting up required various washing conditions either according to the total weight of fiber and the property information stored in the washing information on finding stored washing information as the result of the search, or detecting the quantity of laundry on finding no stored washing information.

2. The washing control method as claimed in claim 1, wherein the washing information includes properties of fiber, weight of fiber, and way of washing of fiber encoded under an agreement with apparel business circle.

3. The washing control method as claimed in claim 1, wherein the step of carrying out washing includes steps of determining washing water level, quantity of detergent, washing period of time, number of times of rinsing, and washing period of time according to total weight of fiber, and determining washing water current and speed of rotation for drying according to the fiber property information.

4. A washing control device of a washing machine comprising:

information mediums having information required in washing for attaching on clothes;

a washing information application sensing means placed on a predetermined position of a washing machine body for sensing washing information recorded on the information mediums on washing;

a system control means for setting up various conditions required for washing and controlling overall system operation of the washing machine according to the washing information sensed through the washing information application sensing means; and a display means for displaying warning in response to a control signal indicating an impossibility of mixed washing transmitted from the system control means.

5. The washing control device as claimed in claim 4, wherein the information medium is washing information of properties of fiber weight of fiber and way of washing of fiber having encoded into bar code.

6. The washing control device as claimed in claim 4, wherein the information medium is washing information of properties of fiber, weight of fiber and way of washing of fiber having recorded on a magnetic tape.

7. The washing control device as claimed in claim 4, wherein the washing information application sensing means includes a light emission means for emitting light to the information medium attached on an article of clothes by a control signal of the system control means, and a light receiving means for receiving light reflected at the information medium and transmits therefrom to the system control means.

* * * * *